United States Patent [19]

Murray

[11] 3,996,821

[45] Dec. 14, 1976

[54] WRENCH ADAPTER KIT FOR BY-PASSING OBSTRUCTIONS

[75] Inventor: Charles T. Murray, Woburn, Mass.

[73] Assignee: TRI Research Corporation, Lynn, Mass.

[22] Filed: Apr. 30, 1975

[21] Appl. No.: 573,097

[52] U.S. Cl. ..... 81/177 A; 81/58

[51] Int. Cl.[2] ..... B25B 13/00

[58] Field of Search ..... 81/177 R, 177 A, 177 F, 81/177 G, 177 ST, 177 UJ, 58

[56] References Cited

UNITED STATES PATENTS

| | | | |
|---|---|---|---|
| 1,169,987 | 2/1916 | Miottel | 81/177 A |
| 1,448,962 | 3/1923 | Hughes | 81/177 ST UX |
| 1,489,696 | 4/1924 | Campbell | 81/177 UJ |
| 1,775,402 | 9/1930 | Mandl | 81/177 A UX |
| 3,039,339 | 6/1962 | Hanson | 81/177 A |

*Primary Examiner*—Al Lawrence Smith
*Assistant Examiner*—James G. Smith
*Attorney, Agent, or Firm*—Weingarten, Maxham & Schurgin

[57] ABSTRACT

A tool kit for use in combination with standard socket, open-end and box-end wrenches to provide a number of special obstruction by-pass tools whereby the wrenches may be releasably and fixedly disposed at any relative angle continuously between 0° and 180° with respect to one another. The tool kit comprises specially constructed elements, including one or more flex adapters and one or more bar extenders. Each flex adapter has a head and a base pivotally connected by means of a special clevis joint having cooperative means on the clevis tongue and the clevis pin for releasably engaging and securing the clevis tongue to the inside of one arm of the clevis yoke at any relative angle of alignment continuously through a total included angle of 180°. The head is adapted to receive a standard socket extender. The base is adapted to removably support a conventional wrench handle or a bar extender. The bar extender is preferably an elongated handle secured to a male socket member. Also included in the kit is a reversible ratchet capable of being reversed from a clockwise to a counterclockwise motion without the use of standard direction-reversing switches.

19 Claims, 8 Drawing Figures

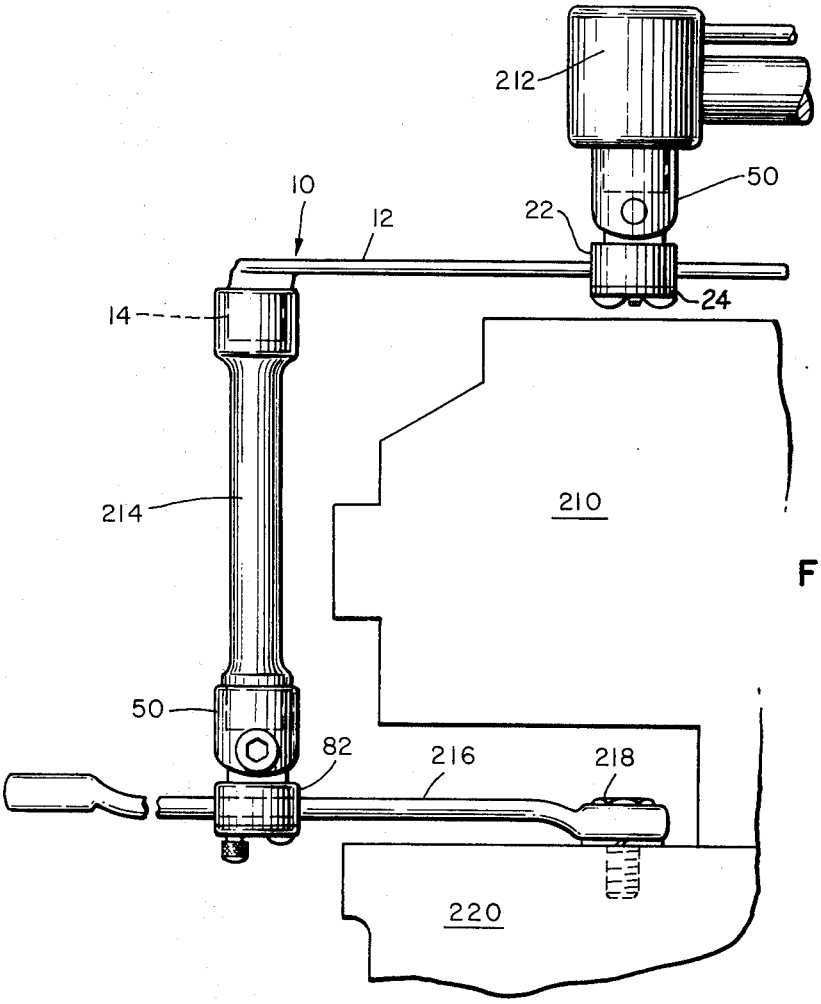
FIG. 5
FIG. 6A
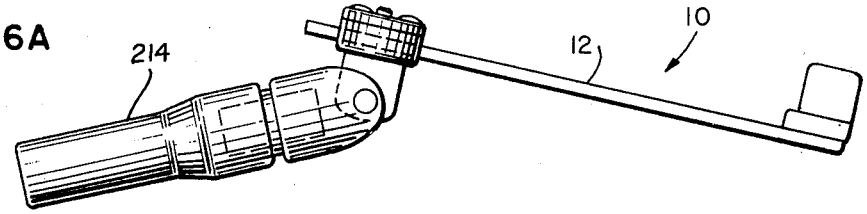
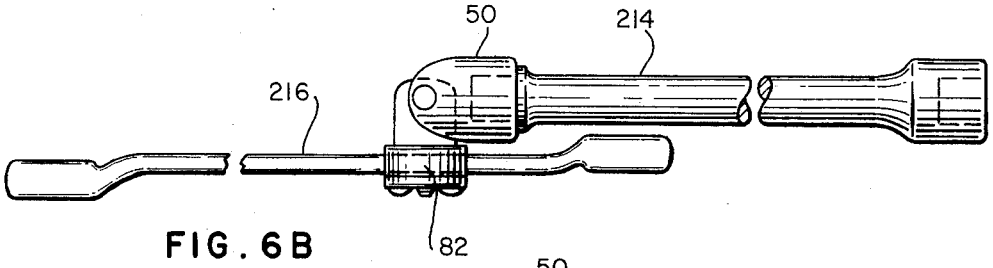
FIG. 6B
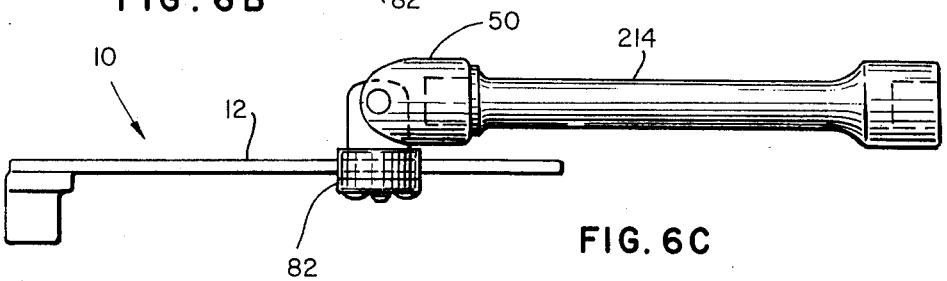
FIG. 6C

WRENCH ADAPTER KIT FOR BY-PASSING OBSTRUCTIONS

FIELD OF THE INVENTION

This invention relates to a tool kit for use with standard socket, box-end and open-end wrenches, and more particularly to a combination of elements employed for adapting such standard wrenches to fashion a plurality of special tools for by-passing obstructions.

BACKGROUND OF THE INVENTION

In the past it has been necessary, in order to obtain access to obstructed fasteners, to use an extensive number of specially designed tools, each capable of negotiating a particular obstruction, but generally not adaptable to a more versatile use. In the automotive and aircraft industries especially, new structures and assemblies include new obstructions and relatively inaccesible nuts and bolt heads for which new tools must be devised. The capital outlay for the many such tools which are necessary, plus the space needed for storing them, are large and many repair facilities have found the requirements for such tools to be quite burdensome.

SUMMARY OF THE INVENTION

The present invention provides a kit to be used with ordinary socket, box-end and open-end wrench sets which will allow a mechanic to build his own specialized tools to by-pass a large variety of obstructions and permit accessibility to difficult-to-reach places. The components of the kit include a specially designed socket ratchet, a special flex angle adapter which may be releasably fixed and pivoted through a total angle of about 180°, and one or more bar extenders.

One end of the flex adapter is compatible with the standard socket wrenches while the other end is designed to removably engage the handle of either an ordinary box or open-end wrench or a socket-type wrench bar extender of the present invention. These wrenches are secured within a channel in the flex adpater by means of a set screw which projects into the channel to engage the wrench handle at any point along its length. One of the important features of the flex adapter is that it may easily be fixed at any angle within its pivotal limitation of 180°. Thus, the relative angular disposition of the socket and open-end or box-end wrenches may be easily changed so as to allow quick and versatile fashioning of a variety of obstruction by-passing tools.

Another feature of this tool kit is a specially designed ratchet, including a handle, a ratchet body and a ratchet wheel having a square projection or socket-engaging head for use with standard socket wrenches. The handle is pivotally mounted to the body which is rotationally mounted to the ratchet wheel. The handle has a tooth for selective engagement with one of a plurality of notches in the ratchet wheel. The handle may be pivoted upwardly to disengage the tooth from a notch, rotated with respect to the ratchet wheel, and pivoted downwardly to engage another notch in the wheel, thereby operating as a ratchet. The ratchet of the present invention is a simple device not easily damaged by the rough use that it is apt to receive under normal working conditions. A primary advantage of this reversible ratchet is that it is operative to rotate the socket head reversibly in either direction without the need for operating a switch to change the ratchet drive motion from clockwise to counterclockwise, as is necessary in conventional ratchet mechanisms.

The elimination of the switching means allows the ratchet to be more ruggedly constructed and therefore less susceptible of damage.

It is evident that the combination of elements comprising the tool kit of the present invention provides a multi-purpose kit for fashioning a large variety of obstruction by-passing tools using standard socket wrenches, box-end and open-end wrenches. The present invention provides a welcome savings to the mechanic who needs an increasing number of specialized tools to deal with the growing complexity of present day machines.

BRIEF DESCRIPTION OF THE DRAWING

The invention will be more fully understood from the following detailed description taken in conjunction with the accompanying drawing wherein:

FIG. 5 is an elevation showing parts of the kit of the instant invention in combination with a standard box-end wrench and torque wrench arranged to by-pass an obstruction to reach an obscured fastener; and FIGS. 6A, 6B and 6C are elevations showing parts of the kit of the instant invention in combination with elements of standard socket, open-end and box-end wrench sets to provide special tools for reaching obscured fasteners.

DETAILED DESCRIPTION OF THE PREFERRED EMBODIMENTS

The kit of this invention normally includes two types of flex adapters which allow various combinations of wrenches to be releasably fixed and pivoted with respect to one another continuously through angles from 0° to 90° in two directions for a total included angle of 180°. One type of flex adapter has a pivoted retainer for fast removal of a tool. In the other flex adapter the retainer is non-pivoted so that a relatively permanent tool engagement is provided. Both types of flex adapters include means for sliding adjustability of the tool held by the adapter. The kit also includes a simple and durable ratchet mechanism for use with a standard socket set.

Figure 1:
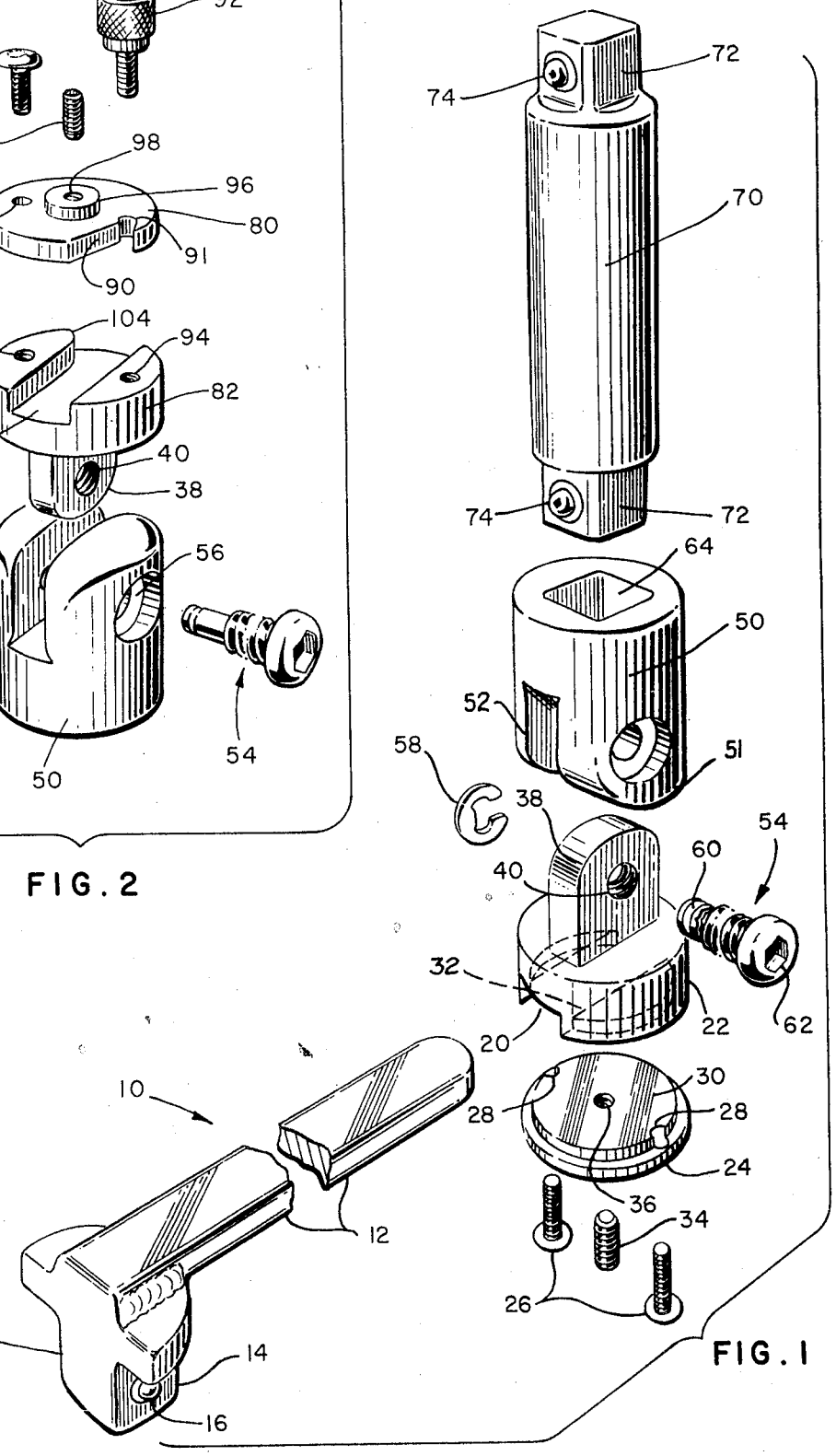
FIG. 1 is an exploded pictorial view of one flex adapter of the invention showing a socket bar extender for coupling to one end and a standard socket extender at the other end.

Referring to FIG. 1, there is shown a flex adapter coupled with a bar extender of the invention and a standard socket extender. A non-ratcheting bar extender 10 has a handle 12 with a convenional male socket engaging head 14, having a spring-loaded detent ball 16, secured to one end of the bar. A flat surface 18 may be provided at the socket end of the handle, if desired, so as to allow the handle to operate with a minimum of clearance. Handle 12 is adapted to be disposed in channel 20, three sides of which are defined by flex adapter base 22. Retainer 24 is secured to base 22 by means of two screws 26 which project through holes 28 in the retainer and engage threaded bores (not shown) in the base, thereby defining the fourth side of channel 20. Raised circular central portion 30 of retainer 24 fits within the similarly shaped countersunk confronting area 32 in flex adapter base 22 to form cooperating arcuate shoulders to insure correct alignment between base 22 and retainer 24. Set screw 34 is threadably engaged through centrally disposed threaded bore 36 in the retainer to adjustably and removably fix handle 12 into position. Projecting from the end of base 22 opposite channel 20 is the clevis tongue 38 having a transverse threaded bore 40 therethrough.

One end of flex adapter head 50 supports two arms 52 of a clevis yoke, each with a transverse non-threaded countersunk bore 56 therethrough. Partially threaded pivot pin 54 is disposed through the respective clevis yoke and clevis tongue bores 56 and 40 to pivotally interconnect the flex adapter base 22 and head 50 and thereby form a clevis joint. Alternatively, pin 54 may be threaded throughout its length and the clevis yoke bores 56 may be oversized to permit a clearance fit between the pin 54 and the yoke bores 56. Snap-ring 58 engages annular recess 60 disposed in the end of pivot pin 54 opposite the head 54 to hold the pin in position in adapter head 50. A tool receiving depression or slot 62 is provided in the head of pin 54 so that it may readily be tightened or loosened. When partially threaded pin 54 is tightened and engages the threads of clevis tongue bore 40, flex adapter base 22 is frictionally engaged and angularly secured to one arm 52 of the clevis yoke. That portion of pivot pin 54 between annular recess 60 and the threads thereon has a length equivalent to the thickness of yoke arm 52 through which it passes, while the threads on said pin do not extend beyond the threaded bore in clevis tongue 38 when in fully tightened position. The other end of flex adapter head 50 contains socket 64. Standard socket extender 70, which is a double male adapter, having a socket engaging head 72 at each end each having a spring-loaded detent ball 74, may be disposed in socket 64. Of course, socket 64 may receive any standard socket tool having similar engaging heads. Thus, the flex adapter of the present invention permits open-end and box-end wrenches or bar extenders mounted in the base 22 to be disposed at any relative angle of alignment continuously through a total angle of approximately 180° with respect to socket wrenches mounted in head 50, to provide a variety of specially adapted obstruction by-pass tools. Note that slidable adjustments of bar extender 10 in slot 20 is permitted by loosening set screw 34.

Figure 2:
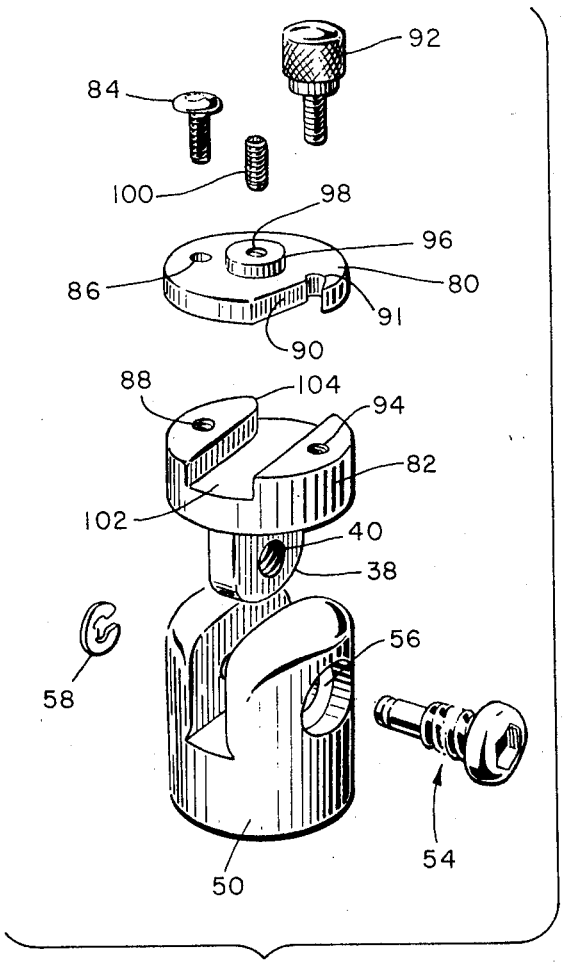
FIG. 2 is an exploded pictorial view of another flex adapter of the invention.

Referring now to FIG. 2, there is shown a somewhat different flex adapter having a retainer 80 which is pivotally secured to flex adapter base 82 by means of screw 84 disposed through hole 86 in the retainer into threaded bore 88 in the base. Pivoted retainer 80 has an offset slot 90 for receiving a knurled bolt 92 which threadably engages bore 94 in base 82. Raised flange 96 is centrally disposed on retainer 80 and has a centrally disposed threaded bore 98 into which set screw 100 is threaded to secure the handle of a bar extender, a box-end or an open-end wrench (not shown) into channel 102 in base 82. The wrench may be easily removed by loosening knurled nut 92, pivoting retainer 80 out of the way and removing the wrench handle from channel 102 in base 82. The corner 104 of base 82 is configured to allow the retainer to be pivoted without fully removing set screw 100, that is, permitting it to project slightly into channel 102, thereby providing for fast removal of the wrench. Note that slot 90 in retainer 80 has a round termination 91 which is not tangent to the flat side of the slot. This is an alternative embodiment, where the flat side of slot 90 adjacent termination 91 abuts bolt 92 when the retainer is pivoted to the closed position. A small amount of force permits the retainer to snap into place with termination 91 closely engaging the stem of bolt 92, thereby providing a positive seat for the retainer. Base 82 is pivotally coupled to adapter head 50 in the same manner as in the embodiment of FIG. 1 and like parts have like reference numerals.

The ends of screws 26, set screw 34 and pin 54 of FIG. 1 and screw 84, set screw 100 and pin 54 of FIG. 2 may be formed to receive an Allen wrench, a blade or a Phillips head screwdriver, as well as other types of tools as desired.

Figure 3:
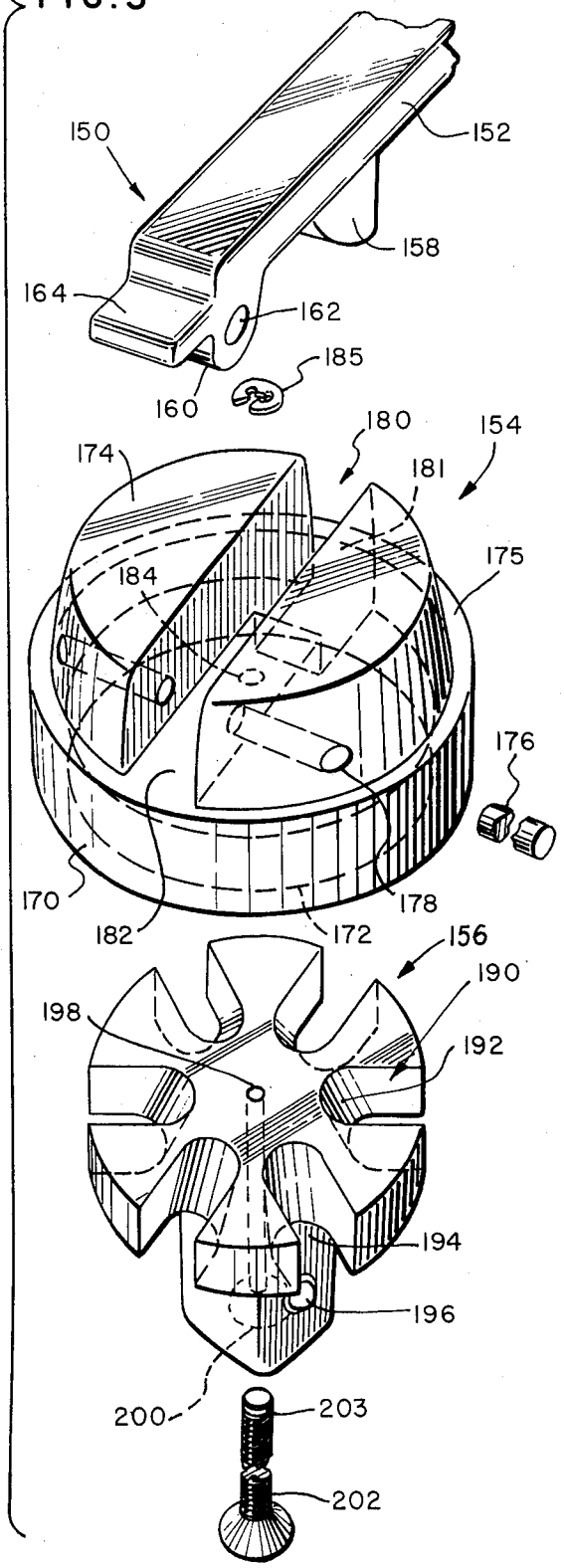
FIG. 3 is an exploded pictorial view of one embodiment of the ratchet of the invention.

Referring now to FIG. 3, there is shown ratchet 150 including handle 152, body 154 and wheel 156. Handle 152 is configured to pivot about one end 160 by means of offset transverse pivot bore 162. The handle may pivot only through a limited angle as determined by stop tang 164, the operation of which will be described hereinbelow. Ratchet handle 152 is also formed with a downwardly disposed, tapered ratchet engaging tooth 158. Ratchet body 154 has a generally cylindrical base 170 with an axial bore 172 therethrough. Generally cylindrical cap 174 is integrally disposed on and axially aligned with base 170. Channel 180 through cap 174 along a cap diameter is adapted to receive handle 152. Pin 176 engages pivot bore 162 of handle 152 through transverse hole 178 in cap 174. The cap outside diameter is somewhat less than the base outside diameter so as to form an annular shoulder 175 providing a surface upon which stop tang 164 bears. Cap channel 180 communicates with axial bore 172 through an opening 181 in the base of cap 174 radially spaced from the axis of body 154, terminating at the inner cylindrical surface of base 170. Tooth 158 normally projects into opening 181 and further into the axial bore 172 when handle 152 is in the lower or engaged position. The remainder of the channel 180 is separated from axial bore 172 by platform 182. Platform 182 has a countersunk bore 184 coaxial with the axial bore 172.

Ratchet wheel 156 is formed with a plurality of radial notches 190, while a socket engaging head 194 depends axially from the center of the ratchet wheel. Spring-loaded detent ball 196 is disposed on socket head 194 to facilitate the engagement of a standard socket (not shown) or with socket 64 in the flex adapter of FIG. 1. Axial bore 198 passes through ratchet wheel 156 and socket head 194 terminating at the lower end of the socket head in a tapered countersunk opening 200. Fastener pin 202 passes into contoured entrance 200, through axial bore 198 and through countersunk bore 184 in the platform 182. C-ring 185 engages annular groove 203 on pin 202 to retain ratchet wheel 156 in rotatable engagement with ratchet body 154. The end of fastener 202 extends into countersunk bore 184 but not into channel 180 so the fastener does not interfere with the ratchet handle 152 disposed in channel 180.

When handle 152 is pivoted downwardly, tooth 158 depends through opening 181 into axial bore 172 so as to engage one of the notches 190 of ratchet wheel 156. Handle 152 is then rotated about the axis of ratchet body 154 so as to turn the entire assembly, thereby rotating a tool wrench (not shown) which may be engaged by head 194. Handle 152 may then be pivoted upward about pivot pin 176 so that tooth 158 disengages the first notch 190 on wheel 156. Handle 152 and base 154 may then be rotated with respect to ratchet wheel 156 back to a starting position where tooth 158 may be pivoted back into engagement with a second notch 190. This procedure may be repeated until the engaged fastener is completely loosened or tightened. It will be readily appreciated that this ratchet is reversible without the need for any ratchet switching mechanism.

Figure 4:
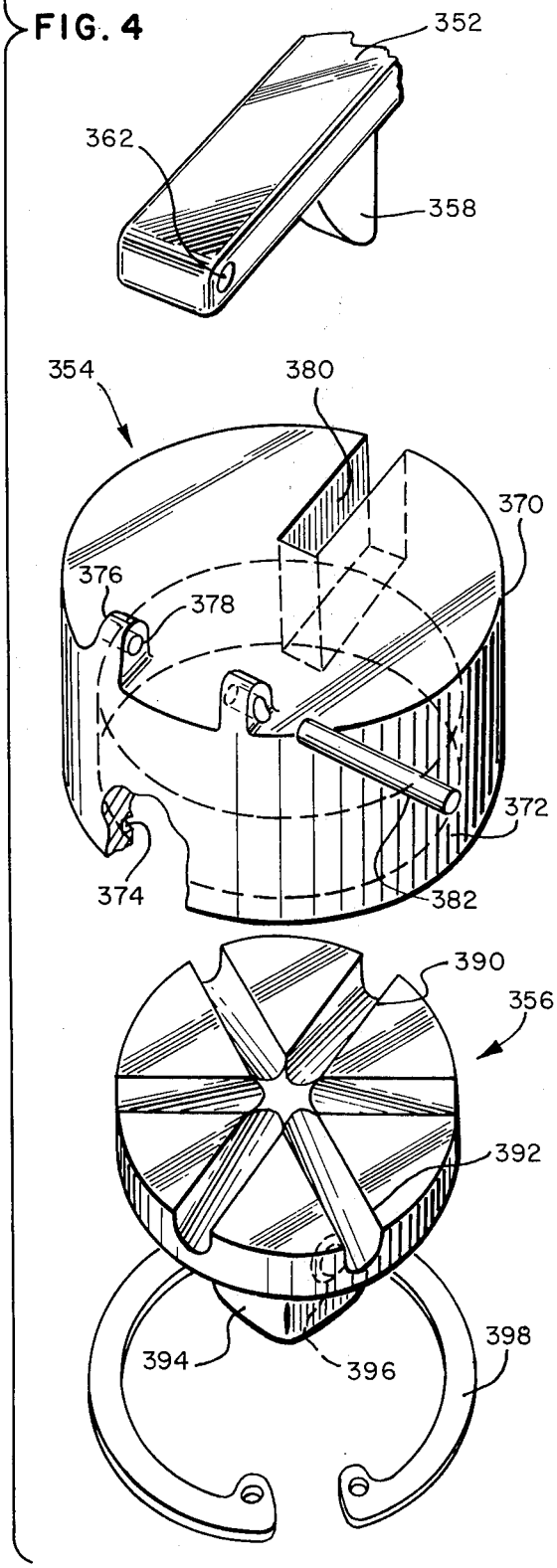
FIG. 4 is an exploded pictorial view of an alternative embodiment of the ratchet of the invention.

Referring now to FIG. 4, there is shown an alternative embodiment of the ratchet of the present invention, including handle 352, body 354 and wheel 356. Handle 352 is formed as a bar having a transverse pivot bore 362 near one end and a downwardly disposed tapered ratchet engaging tooth 358 spaced from pivot bore 362.

Ratchet body 354 is formed with a generally cylindrical body 370 having an axial recess 372 in one end thereof. The inside cylindrical surface of the recess has a snap-ring retaining groove 374. On the other end or top of the ratchet body there are disposed two pivot support posts 376 placed near the circumference of the ratchet body aligned in parallel and offset from a diameter of the cylindrical ratchet body. Each post 376 has a transverse bore 378 therethrough. A pivot pin 382 extends through both bores 378 in posts 376. A radially aligned slot 380 is disposed through the top of the ratchet body along a diameter which passes between the posts 376 and the slot communicates with axial recess 372. Slot 380 extends from a point near the axis of the top portion of body 354 to the periphery thereof but extends only to the wall of the body defining recess 372 at the interface between the slot and the recess. Tooth 358 is disposed in slot 380.

Ratchet wheel 356 has a generally flat cylindrical configuration with a diameter slightly less than the diameter of axial recess 372 and has a plurality of radially extending beveled channels 390 extending partway therethrough, each channel having a curved floor 392. A socket engaging head 394 depends axially from the center of the ratchet wheel 356 on a side opposite from the channels 390. Spring-loaded detent ball 396 is disposed on socket head 394 for normal engagement of a socket wrench (not shown). Snap-ring 398, having an inside diameter less than the outside diameter of the ratchet wheel, cooperates with snap-ring support groove 374 on the inside of axial recess 372 to retain ratchet wheel 356 inside recess 372 and to permit said ratchet wheel to freely rotate inside the recess.

In operation, handle 352 is pivotally mounted to ratchet body 354 by means of pin 382 between pivot posts 376. This alternative embodiment of the ratchet works the same way as the embodiment shown in FIG. 3, with tooth 358 selectably engaging one of the channels 390 in the ratchet wheel. It will be appreciated that this alternative embodiment does not contain the specific stop tang 164 of FIG. 3, but merely employs that portion of the handle 352 which extends beyond bore 362 to abut the top surface of the ratchet body to thereby permit only a limited pivoting of handle 352 about pin 382.

Referring now to FIG. 5, the elements of the tool kit of the present invention are shown in combination with standard socket wrenches, extenders and a standard open-end or box-end wrench. The standard tool elements are combined with the elements of the kit of this invention to fashion a special tool for by-passing obstruction 210 to reach relatively inaccesible fastener 218. More particularly, conventional torque wrench 212 is shown in engagement with flex adapter head 50 of the present invention axially aligned with flex adapter base 22 which engages bar extender 10 by means of non-pivoting retainer 24 of the present invention. Standard socket extension 214 engages head 14 of bar extender handle 12 on one end and another flex adapter head 50 on the other. Pivoted retainer flex adapter base 82 is secured to head 50 in accordance with the clevis joint of the present invention as previously described. One end of standard box-end wrench is disposed in flex adapter base 82 and the other end is disposed about the head of fastener 218 mounted in work piece 220.

Referring now to FIG. 6, there is shown in FIG. 6A, a bar extender 10 disposed in the base of a flex adapter of the present invention, and a standard socket wrench element 214 disposed in the head at an angle with respect to extender 10. FIG. 6B shows a standard socket extension 214 engaged with the head of a flex adapter of the present invention and a standard box-end wrench disposed in parallel offset relationship. FIG. 6C shows a standard socket extension 214 engaging the head of the flex adapter of the present invention and a bar extender engaging a standard socket wrench disposed in the base, again in parallel offset relationship.

The special obstruction by-pass tools shown in FIGS. 5, 6A, 6B and 6C are intended to be only illustrations of some ways of using the elements of the kit of the present invention to fashion specific obstruction by-pass tools. It is, of course, understood that the elements of the kit of the present invention may be used in combination with the elements of standard socket, open-end and box-end wrench sets to fashion almost an unlimited combination of special tools. It will be appreciated that the present invention adds versatility to the tool kit of the user resulting in a substantial savings of expenditures for the purchase of specially designed single-purpose tools and requiring substantially less space as compared with a plurality of such special tools.

In view of the above description, it is likely that modifications and improvements will occur to those skilled in this art which are within the scope of this invention.

What is claimed is:

1. A tool kit for use in combination with conventional socket, open-end and box-end wrenches to enable construction of a plurality of special tools configured to by-pass obstructions to reach obscured fasteners, whereby said wrenches may be releasably fixed at any continuous relative angle with respect to other elements of the special tool constructed with said tool kit, said tool kit comprising:

at least one flex adapter having a head with means at one end adapted to engage a standard male socket engaging head, a base with means at one end adapted to releasably and adjustably secure substantially flat, elongated tool handles at any point along the entire length of said tool handles, and means for releasably securing said head to said base at any desired angle continuously through the total included angular limitation of said flex adapter; and at least one bar extender having a generally flat elongated handle and a standard male socket engaging head at one end thereof, said handle being equivalent in cross section to the handles of a box-end wrench and an open-end wrench and being adapted to be releasably and adjustably secured by said means at said one end of the base of said flex adapter.

2. The tool kit of claim 1 wherein said means for releasably securing said head to said base of said flex adapter comprises a clevis joint having a clevis joke formed with said head and having a first transverse bore therethrough and a clevis tongue formed with said base and having a second transverse bore therethrough, said tongue being pivotally coupled between the arms of said yoke by means of a partially threaded pivot pin, said pivot pin being formed with an enlarged head to bear against the surface of one yoke arm surrounding said first transverse bore through which said pivot pin passes, said tongue having a threaded bore for engaging the threads on said pivot pin, whereby upon tightening said pivot pin, said one yoke arm and said tongue are tightly engaged at any desired angle.

3. The tool kit of claim 2 wherein a first said flex adapter is formed with a transverse channel through said base for receiving the handle of said bar extender slidably adjustable therein and further comprises:

a retainer fixed to said base and defining the outside surface of said channel to form a slot having open ends; and a set screw extending through said retainer to releasably engage said handle thereby permitting slidable adjustments of said handle within said slot.

4. The tool kit of claim 3 wherein said flex adapter is formed with a transverse channel through said base for selectively receiving the handle of said bar extender, the handle of a box-end wrench and the handle of an open-end wrench, said second flex adapter further comprising:

a retainer pivotally secured to said base defining the outside surface of said channel to form a slot having open ends, said retainer having a transverse slot opening into the circumference thereof;

a screw mounted to a threaded hole in sad base and adapted to be engaged by the closed end of said slot, said threaded screw fixing said retainer into position over said channel when engaged by said transverse slot and tightened; and a set screw through said retainer extending into said channel in said base to releasably engage said handle within said channel.

5. The tool kit of claim 1 wherein said means for releasably securing said head to said base of said flex adapter comprises a clevis joint, said clevis joint comprising:

a clevis yoke formed on one of said head and said base and having two spaced confronting arms each having a transverse bore therethrough in alignment with one another;

a clevis tongue formed on the other of said head and said base and having a bore transverse to the plane of said tongue and aligned with said bore of said clevis yoke arms;

a pivot pin pivotally securing said clevis yoke to said clevis tongue; and cooperative means on said clevis tongue, said clevis yoke and said pivot pin for releasably fixedly engaging said clevis tongue with one arm of said clevis yoke at any continuous relative angle of alignment between said tongue and said yoke within the angular limitation of said clevis joint.

6. The tool kit of claim 5 wherein said cooperative means include:

threads formed within said bore through said clevis tongue;

mating threads formed on said pivot pin; and a head disposed on one end of said pivot pin for bearing upon the surface of said one yoke arm surrounding said bore therethrough;

whereby when said threaded pivot pin is tightened into said threaded bore of said clevis tongue, said clevis tongue frictionally engages the inside surface of said one yoke arm thereby securing said clevis yoke to said clevis tongue at a desired angle.

7. The tool kit of claim 6 wherein the angular limitation between said clevis tongue and said clevis yoke includes a total angle substantially equal to 180°.

8. The tool kit of claim 6 and further comprising:

an annular groove in the other end of said pivot pin, that portion of said pivot pin extending through the other of said yoke arms being non-threaded;

a snap-ring disposed in said annular groove and bearing upon the surface of the other of said yoke arms surrounding said bore therethrough, thereby retaining said pivot pin within said bores.

9. The tool kit of claim 5 wherein said base is generally cylindrical and is formed with a transverse channel on one end thereof, said means for releasably and adjustably securing tool handles to said base comprising:

a retainer axially disposed on said base over said channel; and means for pivotally and removably securing said retainer to said base, the handle of a wrench being removably secured in said channel between the confronting surfaces of said base and said retainer.

10. The tool kit of claim 9 wherein said means for securing a wrench in said channel includes a set screw threadably disposed through said retainer and abutting said wrench handle, whereby said wrench is releasably secured against movement in said channel.

11. The tool kit of claim 9 wherein:

said retainer is formed with a raised circular central portion; and the other side of said base is countersunk, thereby forming a recess with arcuate shoulders to facilitate alignment of said retainer with said base.

12. The tool kit of claim 9 wherein said retainer is secured to said base by means of a first bolt about which said retainer is pivotable and a second bolt;

said retainer being formed with a transverse slot opening into the circumference of said retainer, the closed end of said slot engaging said second bolt, whereby when said slot engages said second bolt and said second bolt is screwed tightly into said base, said retainer is secured to said base, releasable upon loosening of said second bolt.

13. The tool kit of claim 12 wherein one corner of said channelled base is beveled to allow said set screw to clear said base when said retainer is pivoted away from said channel while said set screw is in place.

14. A tool kit for use in combination with conventional socket, open-end box-end wrenches to enable construction of a plurality of special tools configured to by-pass obstructions to reach obscured fasteners, whereby said wrenches may be releasably fixed at any continuous relative angle with respect to other elements of the special tool constructed with said tool kit, said tool kit comprising:

at least one flex adapter having a head with means at one end adapted to engage a standard male socket engaging head, a base with means at one end adapted to releasably and adjustably secure substantially flat, elongated tool handles at any point along the entire length of said tool handles, and means for releasably securing said head to said base at any desired angle continuously through the total included angular limitation of said flex adapter;

at least one bar extender having a generally flat elongated handle and a standard male socket engaging head at one end thereof, said handle being equivalent in cross section to the handles of a box-end wrench and an open-end wrench and being adapted to be releasably and adjustably secured by said means at said one end of the base of said flex adapter; and a reversible ratchet having an elongated handle projecting therefrom and a standard male socket engaging head projecting from said reversible ratchet adapted for cooperation with said head of said flex adapter.

15. The tool kit of claim 14 wherein said reversible ratchet comprises:

a generally cylindrical body having a circular recess in one end thereof and a radial slot in the other end thereof communicating with said recess;

a ratchet wheel rotatably mounted within said recess, said ratchet wheel being formed with a plurality of regularly angularly spaced slots and an axially disposed male socket engaging head projecting from one side thereof and;

means for pivotally mounting said elongated handle to said body on the side opposite said recess and extending generally laterally therefrom, said handle being formed with a tooth projecting through said radial slot into said recess for selective engagement with one of said radial slots in said ratchet wheel.

16. The tool kit of claim 15 wherein said elongated handle is also formed with means for limiting the angle through which said handle pivots with respect to said body.

17. The tool kit of claim 16 wherein said means for pivotally mounting said handle to said body comprises a pivot pin mounted laterally to said body parallel with said ratchet wheel and off-set from the axis of said body, said pivot pin passing through a lateral hole through the proximate end of said handle.

18. The tool kit of claim 17 wherein said means for limiting the angle of pivot of said handle comprises an extension of the proximate end of said handle beyond said pivot pin for engaging said body when the distal end of said handle is raised to a predetermined angle sufficient to permit disengagement of said tooth from said ratchet wheel.

19. The tool kit of claim 18 wherein:

said body is formed with an annular groove on the inside surface thereof adjacent the recess opening, said ratchet further comprising:

a snap-ring in said annular groove for retaining said ratchet wheel within said recess in said body.

* * * * *